United States Patent [19]

Day, Jr.

[11] 4,430,541

[45] Feb. 7, 1984

[54] COMBINATION MICROWAVE GAS CONVECTION OVEN

[75] Inventor: William J. Day, Jr., Allentown, Pa.

[73] Assignee: Raytheon Company, Lexington, Mass.

[21] Appl. No.: 447,359

[22] Filed: Dec. 6, 1982

Related U.S. Application Data

[63] Continuation of Ser. No. 225,078, Jan. 14, 1981, abandoned.

[51] Int. Cl.[3] ..... H05B 6/64

[52] U.S. Cl. ..... 219/10.55 R; 219/10.55 F; 126/21 A; 126/39 B

[58] Field of Search ..... 219/10.55 B, 10.55 R, 219/10.55 F, 10.55 M; 126/21 A, 21 R, 273 R, 275 E, 39 B, 39 E

[56] References Cited

U.S. PATENT DOCUMENTS

| | | | |
|---|---|---|---|
| 3,654,417 | 4/1972 | Javes et al. | 219/10.55 R |
| 3,854,219 | 12/1974 | Staats | 219/10.55 R |
| 4,028,521 | 6/1977 | Uyeda et al. | 219/10.55 B X |
| 4,096,369 | 6/1978 | Tanaka et al. | 219/10.55 B |
| 4,132,878 | 1/1979 | Tachikawa et al. | 219/10.55 B |
| 4,211,909 | 7/1980 | Yoshida et al. | 219/10.55 R |
| 4,262,183 | 4/1981 | Smith et al. | 219/10.55 B |
| 4,278,862 | 7/1981 | Mizuno et al. | 219/10.55 B |
| 4,283,614 | 8/1981 | Tanaka et al. | 219/10.55 B X |
| 4,297,558 | 10/1981 | Inayama et al. | 219/10.55 B |
| 4,327,266 | 4/1982 | Austin et al. | 219/10.55 F |

FOREIGN PATENT DOCUMENTS

| | | | |
|---|---|---|---|
| 2912124 | 10/1979 | Fed. Rep. of Germany | 219/10.55 R |
| 2035767 | 6/1980 | United Kingdom | 219/10.55 F |

*Primary Examiner*—B. A. Reynolds
*Assistant Examiner*—Philip H. Leung
*Attorney, Agent, or Firm*—William R. Clark; Joseph D. Pannone

[57] ABSTRACT

A combination microwave gas convection oven having a tubular burner operating in an induced draft environment. A blower system draws air from a combustion chamber forcing it into the heating cavity. The slight pressure created in the combustion chamber draws in air from the heating cavity through perforations communicating therebetween completing the convection recirculation. The negative pressure in the combustion chamber also causes secondary combustion air to be drawn up along the sides of the burner which is positioned adjacent to an aperture in the floor of the combustion chamber. A plurality of top ports in the burner provides low port loading. The structure provides good flame characteristics with low noise of combustion.

4 Claims, 7 Drawing Figures

COMBINATION MICROWAVE GAS CONVECTION OVEN

CROSS-REFERENCE TO RELATED CASES

This is a continuation of application Ser. No. 225,078, filed Jan. 14, 1981, now abandoned.

BACKGROUND OF THE INVENTION

With conventional domestic gas ovens, a blue flame atmospheric burner is typically positioned in a chamber below the oven cavity. The best efficiency has been achieved by providing communicating apertures in the floor of the cavity so that the combustion vapors can pass from the chamber directly into the cavity by natural convection. Furthermore, it has been common to position an additional burner such as a radiant burner in the cavity for broiling. The burners in these described environments are located in large volume atmospheric combustion chambers. Accordingly, almost all conventional blue flame atmospheric burners can be used with favorable results in these applications.

The introduction into the oven of apparatus for energizing the cavity with microwave energy so as to provide a combination microwave gas oven alters the conventional gas technology approach. More specifically, it was found desirable to position the magnetron, power supply, and waveguide coupling underneath the oven cavity in the chamber previously occupied by the gas burner in a conventional gas oven. Therefore, the burner was positioned back of and underneath the oven cavity. The volume to be allocated to the burner in this configuration was further limited by the requirements of isolating the microwave components and oven exterior surfaces from high temperatures; in addition to the damage that could be caused to the microwave components, American National Standard Institute standards regarding fire prevention and burning hazard had to be satisfied. Furthermore, a system of forced convection was preferable because among other reasons, the combustion vapors from the burner at the rear of the oven were to be transferred into the cavity for enhanced efficiency. Also, because of the microwave energy within the cavity, it was not desirable to position a radiant burner therein. The combination of the above described design parameters meant that it was desirable to have a gas burner that operated in a relatively small volume having an induced draft. Also, with the induced draft or negative pressure above the burner, it was desirable to restrict the secondary combustion air so as to improve efficiency.

A variety of conventional atmospheric blue flame burners were installed in the environment described above. However, good flame stability in the negative pressure without the sound of combustion noise was difficult to attain.

Infrared burners, such as, for example, one having a very large port covered by perforated steel or wire mesh layers, were tried as one approach. The flame characteristics were improved over other conventional burners in the negative pressure by the reduced port loading, but the infrared radiant heat was not very efficient for a forced air convection system. Furthermore, the mesh raised to extremely high temperatures in the oven self-clean mode.

Another approach such as described in my U.S. application Ser. No. 4,007, filed Jan. 16, 1979, assigned to the same assignee herein, and hereby incorporated by reference, is a ribbon burner. The tight flame on the top of the ribbon burner and the secondary air flow under induced draft parallel but spaced from the direction of the gas mixture resulted in a relatively quiet flame with good flame characteristics. A longitudinal gap was provided between two ribbon sections to provide improved secondary air entry to the combustion chamber. However, the ribbon burner was substantially more expensive to fabricate than conventional burners. Also, because of the increased burner temperature caused by the tight flame, the burner had to be fabricated of an expensive material such as stainless steel.

SUMMARY OF THE INVENTION

The invention discloses a combination microwave gas convection oven comprising a microwave cavity, means for energizing the cavity with microwave energy, a chamber positioned adjacent to the cavity, means for recirculating vapor between the cavity and the chamber, and a tubular gas burner for providing heat to said chamber, the burner having a plurality of top ports providing low port loading. It may be preferable that the energizing means be a magnetron and that it be positioned below the cavity. The recirculating means may be a blower system and more specifically may preferably be a pair of counter-rotating centrifugal blowers. It is preferable that the burner be positioned below the chamber. The vapor may be recirculated from the cavity to the chamber by way of a plurality of perforations in the wall therebetween. Furthermore, it may be preferable that the blower system be positioned in a second chamber which draws air from the beforementioned chamber and exhaust into the cavity. An example of low port loading may be 20,000 Btu per hr-sq. in. of port area as compared to a typical value of 30,000 Btu per hr-sq. in. of port area. In accordance with the invention, the port loading is less than 25,000 Btu per hr-sq in. of port area.

The invention may also be practiced by a combination microwave gas convection oven comprising a microwave cavity having a wall with a plurality of perforations, means for energizing the cavity with microwave energy, a chamber positioned adjacent to the wall and communication with said cavity through the perforations, means for recirculating air between the cavity and the chamber, and a tubular gas burner for supplying products of combustion to the chamber, the burner having a plurality of top ports providing low port loading. It may be preferable that the gas air mixture be supplied by the burner through an aperture in the floor of the chamber. Also, it may be preferable that the burner be positioned below the floor of the chamber and substantially tangent thereto.

The invention also discloses a microwave cavity having an aperture in the floor thereof, a magnetron positioned below the cavity, a waveguide for coupling microwave energy from the magnetron to the cavity through the aperture, a chamber positioned behind the back wall of the cavity and communicating therebetween by a plurality of perforations in the wall, means for recirculating air between the chamber and the cavity, a burner positioned below the chamber for providing a gas air mixture to the chamber through an aperture in the floor of the chamber, and the burner being tubular and providing relatively low port loading by a plurality of top ports. It may be preferable that the invention further comprise means positioned in the cavity for coupling microwave energy from the aperture into the cavity, the coupling means comprising a rotating member forming a radial waveguide in combination with portions of the floor of the cavity. Also, it may be preferable that the top ports define pairs of elongated slots perpendicular to the length of the tubular burner. These elongated slots may preferably have dimensions of approximately 0.5 inches by 0.03 inches.

The invention may be practiced by a combination microwave gas convection oven comprising a microwave cavity, means for energizing the cavity with microwave energy, a first chamber positioned adjacent to the cavity and communicating therewith by a plurality of holes in a wall of the cavity, a second chamber positioned adjacent to the first chamber and communicating therewith by an aperture in a wall therebetween, a duct communicating between the second chamber and the cavity, a blower positioned in the second chamber for forcing air from the second chamber to the cavity, the input air for the blower coming from the first chamber through the aperture, an opening in the floor of the first chamber providing entrance of air, and a tubular burner having top ports positioned in the flow of air passing through the opening. The first chamber may comprise a combustion chamber for introducing products of combustion into the recirculation system. Further, a second blower may be positioned in the second chamber.

The invention may also disclose a combination microwave gas convection oven comprising a microwave cavity having an aperture in the floor, a megnetron positioned below the cavity, a waveguide coupled to the output of the magnetron, a coaxial conductor for coupling microwave energy from the magnetron to the aperture, a microwave energy coupling member positioned in the cavity and connected to the center conductor of said coaxial conductor, the member forming a radial waveguide in combination with portions of the floor of the cavity, means for rotating the member, a chamber positioned adjacent to the cavity and having an opening in the bottom, means for recirculating air between the cavity and the chamber, and a tubular burner having top ports positioned adjacent to the opening.

BRIEF DESCRIPTION OF THE DRAWINGS

The objects and advantages of the invention will be more fully understood by a reading of the description of the preferred embodiment with reference to the drawings wherein.

DESCRIPTION OF THE PREFERRED EMBODIMENT

Figure 1:
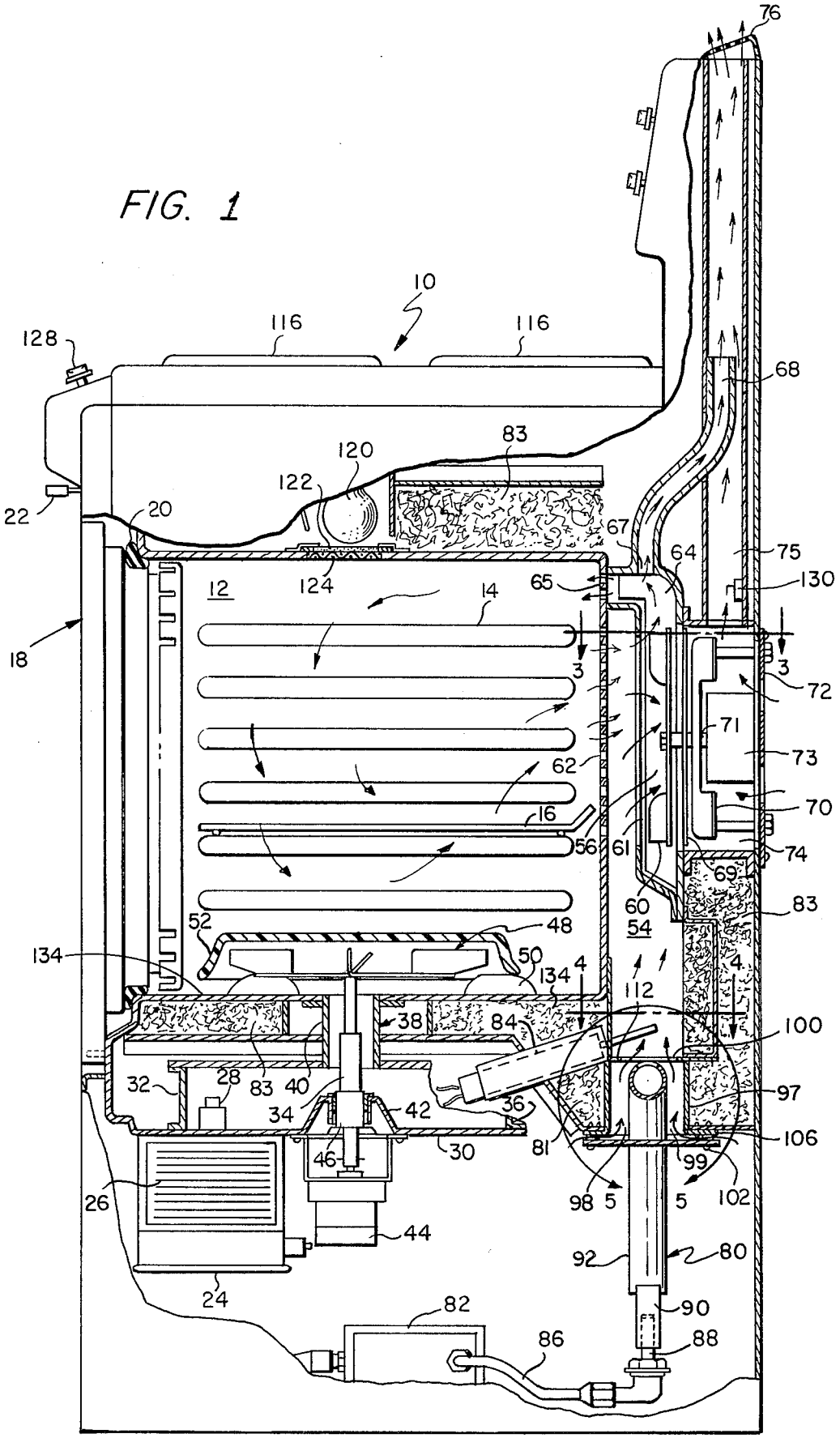
FIG. 1 is a partially cut away view of a combination microwave gas convection oven embodying the invention.
Figure 2:
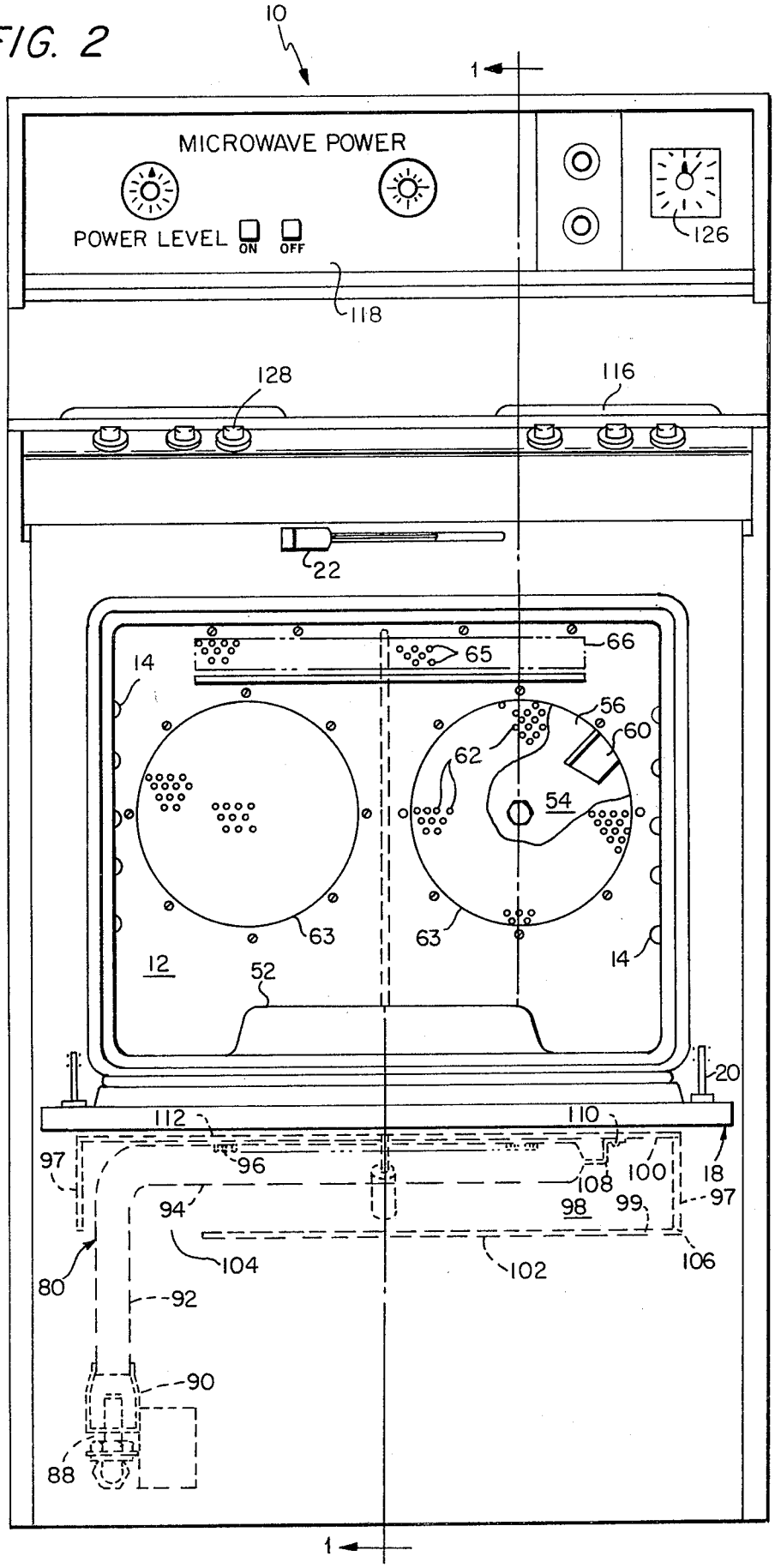
FIG. 2 is a front view of the oven of FIG. 1.

Referring to FIGS. 1 and 2, partially cut away side and front views, respectively, of a combination microwave and convection gas stove 10 are shown. As will be described in detail later herein, food positioned in oven cavity 12 can be cooked simultaneously by microwave energy and gas convection or by either individually. Ridges 14 in the side walls of cavity 12 are provided at different levels to support racks (not shown) or a low loss plate 16 upon which food may be placed. Access to cavity 12 is provided through door 18 which may be of conventional microwave choke design; the door is shown closed in FIG. 1 and open in FIG. 2. Shown in FIG. 1 is a quarter wavelength slotted choke such as described in detail in U.S. Pat. No. 3,767,884.

Thermal gasket 20 surrounds the entire periphery of door 18 and overlaps at the bottom center thereof to substantially form a vapor seal. During the gas convection self clean mode when the temperature in the oven rises to the order of 1000° F., it is desirable to prevent the hot vapors from escaping the cavity around the door. Also, in the convection cook mode, the vapor seal prevents hot vapors from escaping the cavity where they could condense on the cooler outer surfaces. This thermal gasket configuration is different than a microwave electric oven without forced convection where it is desirable to provide a gap in the gasket at the bottom of the door to permit air to flow into the cavity in response to chimney effect within the cavity during self clean. Gasket 20 consists of a rope-like inner insulation material and an outer metallic sheild to suppress the leakage of out of band harmonics as regulated by a government agency. When door 18 is closed, a latch 22 is mechanically moved to lock the door shut and to permit energization of microwave energy.

The source of microwave energy is magnetron 24 which may be of conventional design and preferably provides microwave energy having an approximate frequency of 2450 megacycles. A power supply (not shown) is coupled to the magnetron. Also, a fan (not shown) is used to blow air through the fins 26 of magnetron 24 to cool it. The output probe 28 of magnetron 24 is positioned in and excites waveguide 30 with microwave energy. The distances from output probe 28 to waveguide wall 32 and coaxial center conductor 34 to end termination 36 are selected using well known principles to couple a maximum of energy to coaxial conductor 38. Coaxial conductor 38 comprises center conductor 34 and outer conductor 40. Transition structure 42 provides for maximum coupling into coaxial conductor 38 and also functions as a microwave choke to suppress the leakage of microwave energy from the waveguide along the center conductor to motor 44 which rotates the center conductor. A teflon sleeve 46 is shrunk onto center conductor 34 and provides a tight fitting for support and microwave suppression between center conductor 34 and transition structure 42. The teflon sleeve 46 provides low friction to the transition structure 42 when the center conductor 34 is rotated.

Figure 6:
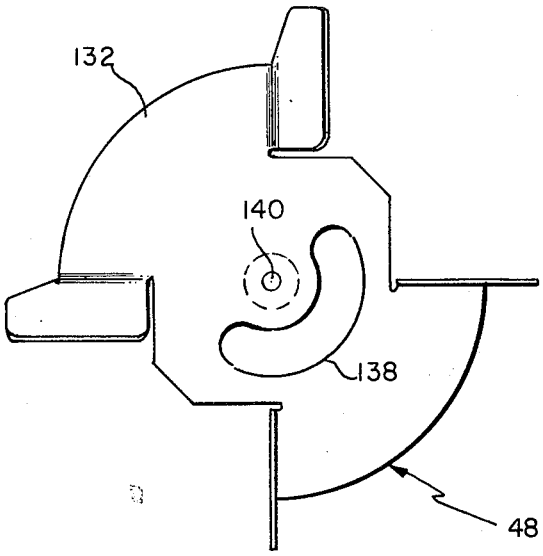
FIG. 6 is a top view of the microwave coupling structure.

The microwave energy travels up coaxial conductor 38 and is coupled into cavity 12 by coupling structure 48. The coupling structure 48 shape, which is shown in detail in FIG. 6, provides two important functions. First, it provides a favorable impedance match between coaxial conductor 38 and cavity 12 so as to provide a maximum transfer of microwave energy. Second, coupling structure 48 provides a desirable microwave energy power distribution within cavity 12. The floor of cavity 12 is raised to form a plurality of bumps 50 upon which microwave transparent dish 52 is supported to provide isolation of coupling structure 48 from the environment of cavity 12. More specifically, dish 52 prevents food spills from falling on coupling structure 48. Further, the dish provides some thermal insulation for the microwave feed structure as described herein.

Air is recirculated through cavity 12, combustion chamber 54 and plenum 56 by a blower system comprising two counter rotating centrifugal blowers 60. Blowers 60 create a slight negative pressure, such as 0.01 to 0.1 inches of water, in the center of plenum 56 which draws air from combustion chamber 54 through a large aperture 61 communicating therebetween. The slight negative pressure so produced in combustion chamber 54 draws air thereinto from cavity 12 through a plurality of circular perforations 62 in the rear wall of cavity 12. Referring specifically to FIG. 2, perforations 62 are positioned in two circular patterns 63 each centered on one of blowers 60. Each pattern 63 consists of 1278 perforations 62 each of 0.156 inch diameter and arranged with 0.188 inch staggered centers. Accordingly, each pattern 63 is approximately 63% open area. Centrifugal blowers 60 create a positive air pressure around the periphery of plenum 56, which pressure forces air through duct 64 into cavity 12. The entrance into cavity 12 is through 712 perforations 65 which are arranged in rectangular pattern 66. The size of perforations 65 is the same as perforations 62; this size is below cutoff for the microwave frequency so that microwave energy does not escape cavity 12 therethrough.

At the upper end of duct 64 is a small opening 67 into outlet vent 68 whereby a small percentage of the recirculating convection air is vented out of the recirculation system. A second pair of blowers 70 which are mounted on the same shafts 71 of blowers 60 are positioned behind the back wall 69 of plenum 56 and function to draw cool air in from the back of stove 10 to cool motors 73 which drive the shafts 71 for blowers 60 and 70. Furthermore, centrifugal blowers 70 provide positive pressure around the periphery of their chambers 74 which causes the air therein to exhaust through duct 75. Outlet vent 68 couples into duct 75 so that the hot recirculation air from cavity 12 is mixed with and cooled by the air in duct 75 before its exhaust through screened aperture 76 at the top of stove 10.

Figure 3:
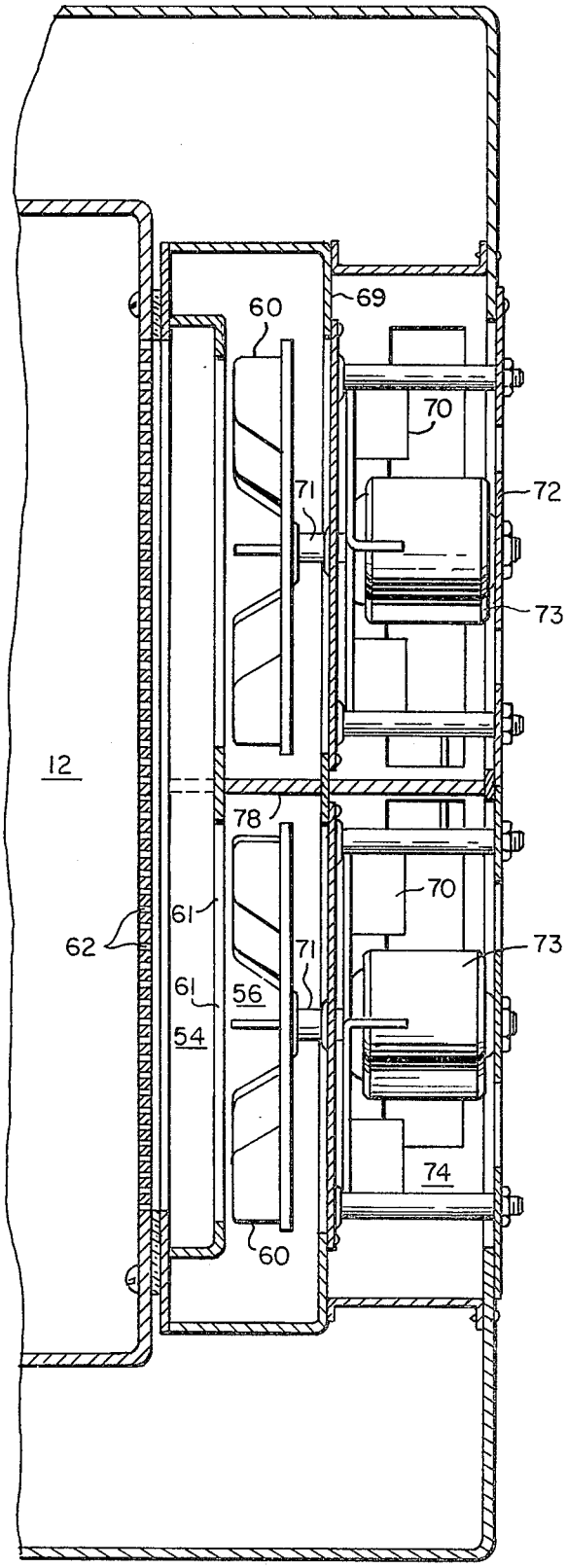
FIG. 3 is a cut away view along line 3—3 of FIG. 1.

Referring to FIG. 3, an expanded view of the recirculation convection system taken along line 3—3 of FIG. 1 is shown. Each of the circular pattern 63 exhaust regions on the rear wall of cavity 12 supplies recirculating convection air from the cavity to a separate blower 60. As described earlier herein, each blower 60 is driven along with a second blower 70 on a common shaft 71 by a separate motor 73 which is mounted on the back wall of the stove in separate chambers 74. A partition 78 between the two blowers 60 prevents tangential interaction of the convection air output of the blowers 60 which rotate in opposite directions to cause the air between the blowers to move upwardly adjacent partition 78. The invention could be practiced by a single blower instead of the dual blowers described and a plurality of different types of ducting systems could also be used. However, it has been determined that the dual counter rotating blower system described herein improves the uniformity of the convection heating in the oven cavity.

As described in the Background herein, the positioning of the microwave components such as magnetron 24 and waveguide 30 beneath cavity 12 meant that the burner 80 could not be positioned in its conventional place directly below cavity 12. Accordingly, as is shown in FIG. 1, burner 80 is positioned to the rear and below cavity 12 immediatey below combustion chamber 54. Insulation material 81 provides thermal insulation for the microwave components. Furthermore insulation material 83 surrounds cavity 12 to thermally insulate the cavity which is especially important during the self cleaning mode when there may be temperatures higher than 1000° F. in cavity 12. With this insulation, stove 10 meets all of the American National Standard Institute standards with regard to fire prevention and burn hazard.

As is well known, input gas to stove 10 passes through a pressure regulator (not shown), low voltage valve 82 activated by silicon carbide ignitor 84, gas line 86, and orifice carrier 88. Nozzle support 90 is welded to the vertical section 92 of burner 80 and positions the burner in the proper fixed alignment with the nozzle of orifice carrier 88. Nozzle support 90 is open in the front and back as viewed in FIG. 2 so that primary combustion air is entrained into the burner to form the gas air mixture. Although it is an objective of the system described herein to obtain an ideal gas combustion air mixture of approximately 1:10, the gas primary combustion air mixture is somewhat greater than with most atmospheric burners, the difference being compensated by mixing less secondary combustion air. It is noted that the vertical section 92 of burner 80 is tubular rather than the typical venturi or narrow throat design; the venturi effect is not required to create the negative pressure in the throat because the burner is operated in an induced draft environment.

Figure 4:
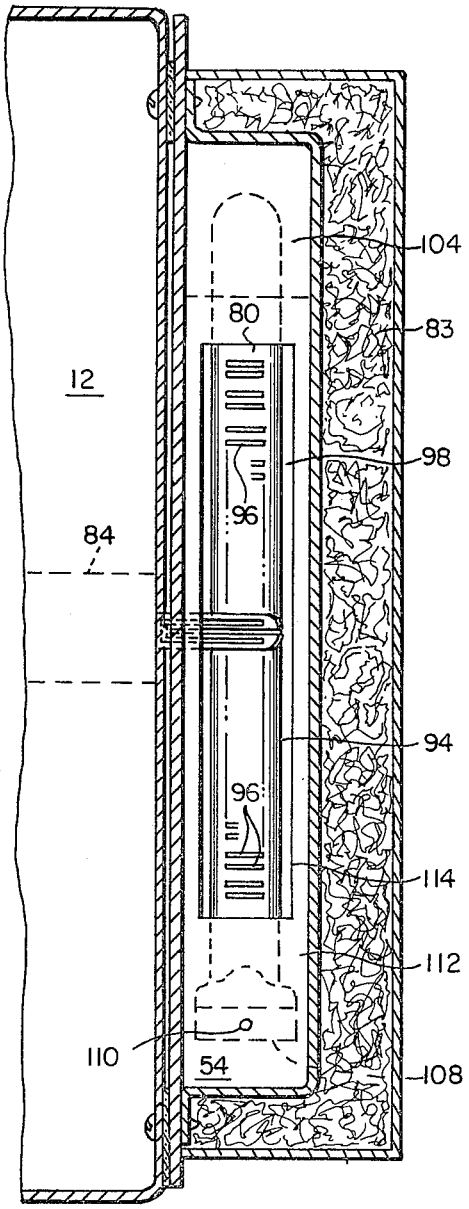
FIG. 4 is a cut away view along line 4—4 of FIG. 1.

Referring to FIG. 4, there is shown a cut away top view looking down into combustion chamber 54 from line 4—4 of FIG. 1. The horizontal section 94 of burner 80 is approximately 20 inches in length with the upper surface being substantially tangential to the plane of the floor 112 of combustion chamber 54. Relatively low port loading which reduces the noise of combustion is provided by 36 pairs of elongated ports 96 perpendicular to the length of the tubular horizontal section. The ports, as shown, are positioned on the top of the burner. Each part has a dimension of approximately 0.032 inches by 0.5 inches. Other port configurations could be used but it is desirable that they be on top and provide low port loading. Burner 80, as described, has a port loading of approximately 20,000 Btu per hr-sq. in. of port area as compared to a typical value of 30,000 Btu per hr-sq. in. of port area. In accordance with the invention, the port loading is less than 25,000 Btu per hr-sq in. of port area. Both the horizontal and vertical sections of the burner have a diameter of approximately one inch.

Figure 5:
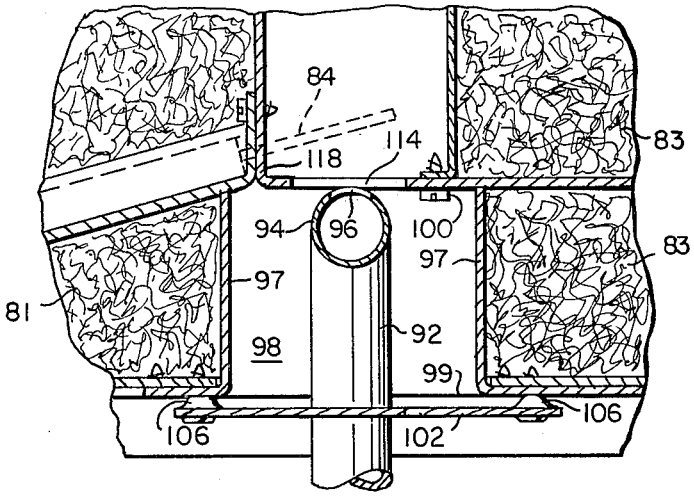
FIG. 5 is an expanded view along line 5—5 of FIG. 1.

Referring to FIG. 5, there is an enlarged side view of burner 80 as shown in FIG. 1. Collar 97 forms a rectangular tunnel 98 having an opening 99 at the bottom and an opening 100 at the top adjacent to the combustion chamber, the tunnel being elongated in width so as to house burner 80. A substantial part of opening 99 at the bottom is covered by plate 102 which is spaced from the bottom of collar 97 by 0.375 inches. Plate 102 does not extend the entire length of collar 97 leaving area 104 as shown in FIG. 2 for the vertical section 92 of burner 80 to enter tunnel 98. Accordingly, secondary combustion air may enter tunnel 98 in the 0.375 inch gap 106 between collar 97 and plate 102 or through area 104.

The end of horizontal section 94 of burner 80 is pressed down and formed into a mount 108 which is attached by sheet metal screw 110 to the under side of floor 112 of combustion chamber 54. As stated earlier herein, the horizontal section 94 of burner 80 is substantially tangential to the under side of floor 112 of combustion chamber 54. As shown best in FIG. 4, floor 112 of combustion chamber 54 has a rectangular aperture 114. The width of aperture 114 is approximately 1.5 inches and the length, as shown, is slightly longer than the length of the horizontal section having slots which may preferably be approximately 15 inches. The relatively low port loading described earlier herein must be provided in a relatively small area of the burner because aperture 114 limits to exposure area and it is preferable that the ports be on the top of the burner. Aperture 114 is limited in size to restrict the amount of secondary combustion air flowing therethrough toward the negative pressure so as to increase efficiency. The depth of combustion chamber 54 along floor 112 may preferably be slightly larger than 2 inches tapering to a depth of approximately one inch at the top of the chamber immediately in front of blowers 60.

When the gas burner is to be activated, silicon carbide ignitor 84 is electrically energized and heats to a temperature which will ignite an air gas mixture whereupon valve 82 opens, thereby causing said mixture to emanate slots 96. As stated earlier, the primary combustion air enters at nozzle support 90. The secondary air enters around 0.375 inch gap 106 and area 104 and flows up through aperture 114 adjacent to burner 80 into combustion chamber 54. As described earlier herein, blowers 60 create a slight negative pressure in combustion chamber 54 which causes all to be drawn through perforations 62 from cavity 12. The slight negative pressure also causes air to be drawn into combustion chamber 54 through aperture 114 putting burner 80 in an induced draft environment. It has been found that burner 80, as described earlier herein, operates in this induced draft environment with good flame characteristics and without the noise of combustion. The combustion vapors from burner 80 add to and become part of the recirculating convection air. Outlet vent 68 compensates for the addition of combustion vapors into the recirculation system through aperture 114. The structure defined herein provides a desirable and efficient balance between recirculating air and added combustion vapors. It is noted that the blower system so described and air recirculation is activated when the magnetron is turned on, even if the gas burner is not simultaneously activated; in this case, the recirculation is used to remove water vapor from cavity 12 rather than to introduce heat.

Figure 7:
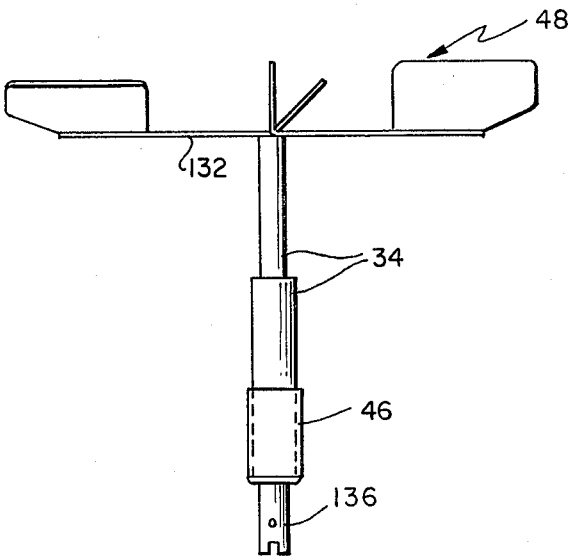
FIG. 7 is a side view of the coupling structure of FIG. 6 also including the center conductor.

Referring to FIGS. 6 and 7, top and side elevation views respectively of microwave coupling structure 48 are shown. As stated earlier herein, coupling structure 48 performs two functions and its shape is selected to optimize with regard thereto. First, it is important that coupling structure 48 provide a favorable impedance match between coaxial conductor 38 and cavity 12 for a wide variety of food loads. A proper impedance match results in a maximum power transfer and improved efficiency. Second, it is desirable to transfer the microwave energy into the cavity uniformly so as to eliminate hot spots within food bodies. Furthermore, it has been found desirable to have coupling structure 48 operate as a directive antenna whereby a substantial amount of the coupled microwave energy is incident on the food body before being reflected from the walls of the cavity setting up a complex standing wave pattern. Also, it has been found that it is desirable to have a concentration of power directly up from coupling structure 48 through the center of cavity 12 rather than angled out towards the sides of the cavity; this provides for more uniform cooking in many food bodies such as cakes. Without this concentration or focusing of energy in the center, cakes may exhibit a fringing effect whereby energy concentrates at the edges of the cake causing the edges to be done while the center is still undone and soggy.

Still referring to FIGS. 6 and 7, plate 132 functions as one conducting surface of a radial waveguide excited by coaxial conductor 138. The other conducting surface of the radial waveguide is the floor 134 of cavity 12. As described earlier herein, motor 44 coupled to extension 136 of center conductor 34 causes coupling structure 48 to rotate for improved uniformity of the microwave radiation pattern in cavity 12. Accordingly, one of the conductor surfaces, plate 132, of the radial waveguide is in motion while the other conductor surface, floor 134, is stationary.

Still referring to FIG. 6, plate 132 has a slot 138 therein. From the center of rotation of plate 132 at hole 140 cut therein for mounting to center conductor 34, the inner and outer radii of slot 138 may preferably be approximately 0.67 and 1.3 inches respectively. The length of slot 138 may preferably be defined by a 180° arc from hole 140. So defined, it may be preferable that slot 138 be resonant or one half wavelength at its inner radial dimension so that there is a maximum coupling of energy through it from the radial waveguide into cavity 12. Slot 134 provides for the concentration or focusing of energy directly up from the coupling structure 48 previously described herein as being desirable.

Referring again to FIGS. 1 and 2, a plurality of top gas burners 116 is provided; these burners operate as conventional gas surface burners in accordance with well-known practice and may be activated by controls 128. Many other conventional features are also incorporated into stove 10. For example, a temperature sensor (not shown) may preferably be mounted within cavity 12 to provide an output used to control the gas heating cycle so as to regulate the cooking temperature in the cavity. Preferably, the positioning of the temperature sensor is such that vapors from rectangular pattern 66 do not impinge directly upon it. Also, the microwave energy power level and activation time may be controlled by control panel 118. Furthermore, a light bulb 120 positioned outside cavity 12 may provide light to the cavity through a light transparent high temperature ceramic 122 and microwave shield screen 124. Also, clock 126 may be used to initiate heating operations at a preselected time.

A safety control circuit is provided in which air flow sensor 130 comprising a vane actuated switch is positioned in duct 75. It is used to prevent the supply of gas to burner 80 unless the air recirculation system comprising blowers 60 is activated. Accordingly, after the operator selects a temperature for cavity 12 and activates convection heating, the automatic sequence of events may be blowers 60 begin to recirculate air, air flow sensor 130 switch closes as a result of exhaust air in duct 75, silicon carbide ignitor 84 activates and then, after a delay for the ignitor to heat up to a temperature sufficient to ignite burner 80, low voltage valve 82 opens and the gas is supplied to orifice carrier 88.

This completes the description of the preferred embodiment of the invention described herein. However, numerous modifications thereof will be apparent to one of ordinary skill in the art without departing from the spirit and scope of the invention. Accordingly, it is intended that the scope of the invention be limited only by the appended claims.

What is claimed is:

1. A combination microwave gas convection oven comprising:

a microwave cavity having a bottom with an opening;

a magnetron positioned below said cavity;

a waveguide for coupling microwave energy from said magnetron to said cavity through said opening;

a chamber positioned behind the back wall of said cavity and communicating therebetween by a plurality of perforations in said back wall, said chamber having a floor with an aperture;

means for recirculating air between said chamber and said cavity, said recirculating means comprising an outlet vent for exhausting a small percentage of recirculating air from said oven, said recirculating means creating a slight negative pressure in said chamber wherein an induced draft is provided into said chamber through said aperture;

a tubular gas burner positioned below said chamber for providing a gas air mixture to said chamber through said aperture in said floor of said chamber, the size of said aperture restricting the amount of secondary combustion air flowing therethrough in said induced draft toward said slight negative pressure thereby increasing the efficiency of said burner; and said burner having a plurality of top ports, said burner having a port loading of less than 25,000 Btu per hr-sq in. of port area at the maximum operating Btu rate of said burner.

2. The oven recited in claim 1 further comprising means positioned in said cavity for coupling microwave energy from said opening into said cavity, said coupling means comprising a rotating member forming a radial waveguide in combination with portions of said bottom of said cavity.

3. The oven recited in claim 1 wherein said top ports define pairs of elongated slots perpendicular to the length of said tubular burner.

4. The oven recited in claim 3 wherein the dimensions of said slots are approximately 0.5 inches by 0.03 inches.

* * * * *